United States Patent [19]

Callera et al.

[11] Patent Number: 4,915,817

[45] Date of Patent: Apr. 10, 1990

[54] PROCESS FOR THE FLEXIBLE PRODUCTION OF HIGH-QUALITY GAS OIL

[75] Inventors: Gilberto Callera, Rome; Antonio Cerase, Rome; Luciano Vinti, Rome; Andrea D'Alberton, Venice, all of Italy

[73] Assignee: AGIP Petroli S.p.A., Rome, Italy

[21] Appl. No.: 271,443

[22] Filed: Nov. 15, 1988

[30] Foreign Application Priority Data

Nov. 18, 1987 [IT] Italy ..... 22683 A/87

[51] Int. Cl.[4] ..... C10G 67/00

[52] U.S. Cl. ..... 208/97; 208/28; 208/80; 208/177; 208/301; 208/302; 208/211; 208/DIG. 1; 585/739

[58] Field of Search ..... 208/28, 80, 97, 177, 208/301, 302, 211, DIG. 1; 585/739

[56] References Cited

U.S. PATENT DOCUMENTS

| | | | |
|---|---|---|---|
| 3,801,495 | 4/1974 | Gould | 208/97 |
| 4,073,718 | 2/1978 | Hamner | 208/80 |
| 4,605,488 | 8/1986 | Chester et al. | 208/78 |
| 4,610,778 | 9/1986 | Graven | 208/97 |
| 4,810,357 | 3/1989 | Chester et al. | 208/78 |

*Primary Examiner*—Helane Myers

*Attorney, Agent, or Firm*—Oblon, Spivak, McClelland, Maier & Neustadt

[57] ABSTRACT

An improved process for the flexible production of high-quality gas oil from two crude gas oil feedstocks deriving from primary fractionation consisting of subjecting the heavy crude gas oil feedstock to catalytic dewaxing in the presence of hydrogen, adding a lighter crude gas oil feedstock to the actual effluent from the dewaxing stage and subjecting these feedstocks simultaneously to catalytic desulphurization.

7 Claims, 1 Drawing Sheet

PROCESS FOR THE FLEXIBLE PRODUCTION OF HIGH-QUALITY GAS OIL

Figure 1:
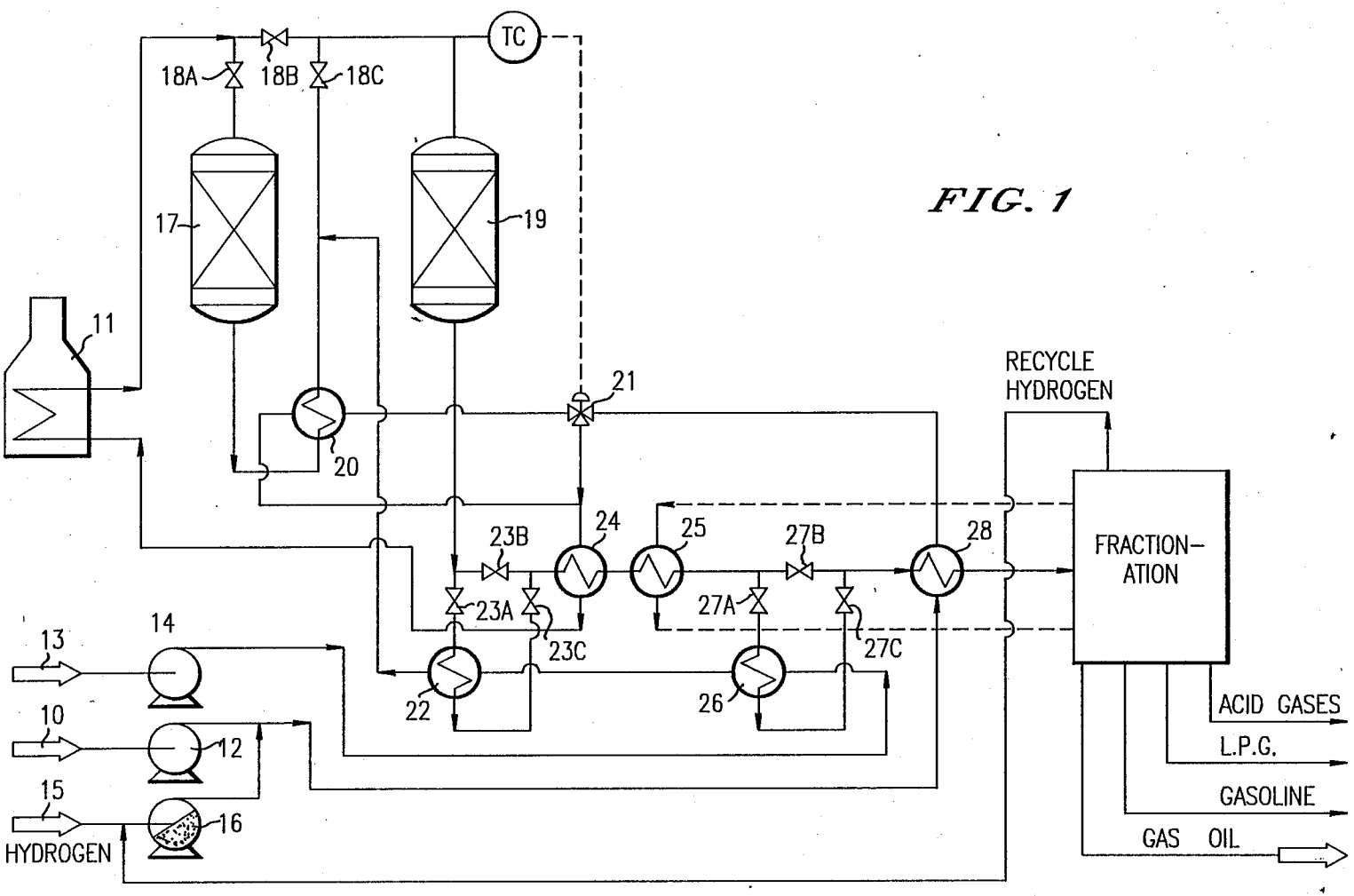

This invention relates to a method for producing high-quality gas oil from heavy feedstocks which is highly flexible both in relation to variation in feedstocks to be processed and in relation to seasonal demand variations.

In recent years there has been a considerable increase in the demand for gas oil compared with other petroleum-derived energy products, and this has resulted in a requirement for increased gas oil yield from the processed crude, at the expense of the heavy fractions which were previously used as fuel oil. This increase can be attributed both to the increasing use of gas oil for domestic heating in place of fuel oil which produces pollutant emission, and to the increasing use of diesel engines for autotraction.

Particularly for this latter application, very stringent limits have been defined both on sulphur content $<<0.3\%$ by weight) and on low-temperature properties.

The most important parameter for measuring the low-temperature characteristics is the cloud point (or more simply CP) which indicates the commencement of segregation of wax crystals representing linear high-boiling paraffins. These crystals, particularly just after starting a diesel engine, block the filters which protect the injection system and cause the engine to stop, which then requires a very elaborate procedure for its restarting.

Other significant parameters related to the low-temperature characteristics are pour point(PP) and cold filter plugging point (CFPP). These parameters are coded and measured by the ASTM and DIN methods and generally vary in a mutually coherent manner. The pour points can be reduced by using additives, but these have no appreciable effect on the cloud point.

Generally, gas oil is produced from two fractions deriving from primary distillation of the crude.

The first fraction consists of light gas oils deriving from topping—or atmospheric distillation—and has an initial distillation temperature of 170°-190° C. and a final distillation temperature of 330°-340° C.

This fraction does not contain high-boiling linear paraffins able to induce cloud points outside the norm, and therefore generally requires only desulphurizing treatment. In contrast, the other fraction consists of heavy gas oils obtained from topping possibly combined with a part of the gas oil obtained from vacuum distillation.

This heavy fraction can have final distillation temperatures which reach 450° C. and beyond, and contains large quantities of high-boiling paraffins which induce too high cloud points in it. The heavy fraction therefore requires processing to remove these high-boiling components which negatively influence the low-temperature properties of the gas oil produced from this heavy fraction, plus desulphurizing to reduce the sulphur content to below the prescribed limit.

In the current market situation this use of heavy gas oils is very attractive both because of the high demand of gas oil compared with other petroleum derivatives, and because of the considerable price difference between gas oil and fuel oil.

In the prior art, a catalytic dewaxing process has been proposed by Mobil Oil Corporation which is commonly known as MDDW (Mobil Distillate Dewaxing).

This process is fully described, both in the patent literature and in articles in the Oil and Gas Journal of 6/6/1977 pp. 165-170 and in Hydrocarbon Processing of May 1979 pp. 119-122.

The described process consists of two stages, namely catalytic dewaxing and desulphurization.

Catalytic dewaxing is conducted in fixed bed reactors over aluminosilicate catalysts in the presence of hydrogen. These catalysts have high selectivity towards normal paraffins and towards ceratin long-chain isoparaffins which are split into lighter components, to allow the other components to pass substantially unchanged.

The reaction—which is weakly endothermic—is conducted at a pressure of 20-40 atm, with a gaseous hydrogen:liquid feedstock volume ratio of 100-500, at a temperature of 300°-430° C. The level of dewaxing, which determines the lowering in the CP value, is determined by the severity of the process, which is controlled by the space velocity and the operating temperature.

During the life cycle of the catalyst the temperature is increased to maintain the low-temperature properties of the resultant product constant.

The dewaxed product is then fed to desulphurization, in one of two alternative versions; either the effluent product is fed as such to the desulphurization or can be distilled to recover the light products produced in the MDDW and only the heavy part is fed to desulphurization. If the second option is used, the hydrogen circuit required for the two stages is also separated.

The desulphurization treatment consists of hydrogenation conducted at 290°-390° C. under 20-40 atm pressure in fixed bed reactors using catalysts comprising Ni/Mo, Ni/W, Ni/Co/Mo or Co/Mo on an alumina support, maintaining a partial hydrogen pressure of at least 10 atm at the reactor outlet.

The severity of this treatment is controlled by the temperature, space velocity and hydrogen partial pressure.

The temperature of the desulphurization reactor is also increased during the life cycle of the catalyst to keep its performance constant.

The demand for gas oil is subject to considerable seasonal variation both in terms of quantity and in terms of quality. The quantity variations are due to the essentially seasonal character of the demand for domestic heating, which is concentrated in the cold months of the year (generally october-april) whereas quality variations are due to the lower temperatures during the cold months which impose lower cloud point and pour point limits in order to ensure correct cold operation of diesel engines and particularly those for automobiles, which are more susceptible to cold weather for constructional and applicational reasons.

By way of example, the prescribed gas oil low-temperature properties for certain European countries are given below.

| | | | |
|---|---|---|---|
| Germany: | CFPP | summer | <0° C. |
| | CFPP | winter | <−15° C. |
| France: | CFPP | summer | <0° C. |
| | CFPP | winter | <−12° C. |
| | PP | summer | <−7° C. |
| | PP | winter | <−15° C. |
| Austria: | CFPP | summer | <+5° C. |

-continued

| | | | |
|---|---|---|---|
| | CFPP | winter | $<-15°$ C. |
| | PP | summer | $<-6°$ C. |
| Great Britain: | CFPP | summer | $<0°$ C. |
| | CFPP | winter | $<-9°$ C. |

These seasonal variations are satisfied by feeding the gas oil market with varying quantities of light and heavy fractions obtained by topping and vacuum distillation in variable proportions according to refinery availability and market demand. These circumstances also make it possible to vary the cutoff point between these fractions. In particular the present invention relates to an improved process for the dewaxing and desulphurization of gas oil which is able to satisfy the seasonal variations in the demand for gas oil by providing a high degree of flexibility.

The process of the present invention is described hereinafter with reference to FIG. 1 which shows a typical embodiment thereof by way of non-limiting example.

In the diagram of FIG. 1:

10 indicates the gas oil feed which is raised to reaction temperature by being pumped by the feed pump 12 through the furnace 11;

13 indicates the gas oil feed pumped directly to desulphurization by the pump 14, without passing through the furnace 11;

15 indicates the make-up hydrogen feed which joins the recycle hydrogen and is then compressed through the compressor 16;

17 indicates the catalytic dewaxing reactor and 18 A/B/C the valves for connecting it into or cutting it out of the cycle;

19 indicates the desulphurization reactor;

20 indicates the heat exchanger between the effluent from the dewaxing reactor 17 and the feed 10;

21 indicates a valve which allows the heat exchanger 20 to undergo zero/partial/total bypass by the feed 10;

the desulphurized effluent from the reactor 19 passes through the heat exchangers 22, 24, 25, 26, 28 in that order;

22 indicates the heat exchanger between the effluent from the desulphurization reactor 19 and the feed 13 before being fed to desulphurization, and 23 A/B/C indicate the valves used to exclude it from the circuit when there is no feed 13;

24 indicates the heat exchanger between the effluent from the desulphurization reactor 19 and the feed 10 after its preheating in 28 and 20 but before its entry to the furnace 11;

25 indicates a further heat exchanger between the effluent from the desulphurization reactor 19 and a stream from the fractionation stage for recovering the heat still available in the effluent from the reactor 19;

26 indicates a heat exchanger for initial preheating of the feed 13 against the effluent from the reactor 19, its exclusion valves being indicated by 27 A/B/C;

28 indicates a heat exchanger for initial preheating of the feed 10 against the effluent from the reactor 19.

After heat transfer through 28, the effluent from the desulphurization reactor 19 is transferred to the fractionation zone from which the following are obtained:

recycle gas containing hydrogen
acid gases containing $H_2S$
light hydrocarbons for use in LPG
gasoline produced in the dewaxing stage desulphurized gas oil with the required low-temperature characteristics.

The method for processing light and heavy gas oil fractions in various alternative combinations is described hereinafter, reference being made to a dewaxing reactor capacity of 4000 barrels per day in order to better clarify the advantages and characteristics of the invention compared with the prior art. If the feedstock to be processed consists only of a heavy gas oil fraction, or generally one having poor low-temperature characteristics, this feedstock is fed by the feed path 10 and pump 12, whereas the pump 14 and therefore the feed path 13 are not used.

The following valves are kept closed: 18B, 23A and 23C—to exclude the heat exchanger 22—and 27A and 27C—to exclude the heat exchanger 26.

The feedstock in the form of the heavy fraction is thus fed by means of the pump 12, and treatment hydrogen is added, this consisting of the recycle stream from the fractionation step plus the make-up hydrogen fed through 15, these being compressed to the operating pressure by the compressor 16.

After preheating through 28, 20 and 24, the gas oil plus gaseous phase mixture is passed through the furnace 11 where its temperature is raised to the required value for entry into the dewaxing reactor 17.

The high-boiling normal paraffin components are cracked in this reactor to produce light components, these being a $C_3$–$C_4$ fraction for LPG use, plus a gasoline of high olefin content.

The feed temperature to the dewaxing reactor is controlled by monitoring the results of measuring the low-temperature characteristics of gas oil samples taken directly downstream of the reactor 17.

The effluent from the reactor 17 is fed as such to the desulphurization reactor 19.

The desulphurization reaction is conducted substantially at the same pressure as the dewaxing reaction.

The inlet temperature to the reactor 19 is controlled by the valve 21 which controls the throughput through the heat exchanger 20 by diverting a part directly to the heat exchanger 24.

The maximum inlet temperature to the reactor 19 corresponds to total bypass of the heat exchanger 20, and minimum operating temperature of the reactor 19 corresponds to passing the entire feed from 28 through the heat exchanger 20. Varying the flow by means of 21 corresponds to intermediate temperatures. As is apparent from the flow diagram of FIG. 1, the required relationship between the temperature and the remaining life of the catalyst can be satisfied by simply controlling the furnace 11$\Delta T$ and the amount bypassed by the valve 21.

Desulphurization of the effluent from the reactor 17 takes place in the desulphurization reactor 19 by converting the sulphur contained in the hydrocarbon molecules into $H_2S$ which is transferred into the gaseous phase. The severity of the hydrogenation process induces the simultaneous exothermic hydrogenation of a considerable part of the lighter olefin components produced in the preceding dewaxing stage. It should also be noted that the heavy gas oil fractions generally have a sulphur content much higher than that of the light gas oil fractions, and that the sulphur contained in the heavy fractions is particularly more resistant to removal.

This series of circumstances therefore compels low space velocity operation in order to obtain a gas oil with a sulphur content within the norm.

If on the other hand the feedstock to be treated does not require dewaxing either because it consists of a heavy gas oil fraction which already has good low-temperature characteristics or because it consists of a light gas oil fraction which generally already has good intrinsic low-temperature characteristics, this feedstock needs only desulphurization to bring its sulphur content within the norm.

Compared with the previous configuration, both the dewaxing reactor 17 and the heat exchanger 20 are excluded, the valve 18B is opened and the valves 18A and 18C closed. The valve 21 is in the position which completely bypasses the heat exchanger 20.

Because of the aforesaid considerations, the reactor 19 which for treating heavy gas oil fractions was able to handle about 4000 barrels per day is now able to handle 8000 barrels per day.

This is because the sulphur content of light gas oil fractions is generally lower, they are easier to desulphurize and there are no simultaneous exothermic olefin hydrogenation reactions.

In the cases analyzed up to this point, the flow diagram of FIG. 1, by suitable modification of its configuration, has been used for different conventional treatment processes. In contrast, the process of most interest, which allows simultaneous treatment of both heavy and light gas oil fractions and enables production to be adapted to seasonal demand, is conducted in the following manner.

The heavy gas oil fraction is fed from the line 10 by the pump 12 through the heat exchangers 28, 20 and 24 and the furnace 11.

The valves 18B, 23B and 27B are closed.

The heat exchangers 22 and 26 which in the previously examined cases were excluded from the circuit are not connected in.

The light gas oil fraction is fed from the line 13 by the pump 14 through the heat exchangers 26 and 22, is then added to the effluent from the dewaxing reactor 17 which has already been cooled through 20, and is then directly fed to desulphurization. The desulphurization of the light gas oil fraction fed through 13 does not require preheating in the furnace 11 as this is achieved differently against the reaction products, and does not require supplementary hydrogen as the excess hydrogen required by the dewaxing stage is already sufficient, and furthermore no additional capacity is required for it in the reactor 19 used for the desulphurization stage.

In this respect it has been surprisingly found that the reaction volume required for desulphurizing 4000 barrels per day of heavy gas oil fractions to meet specification is also able to simultaneously desulphurize 4000 barrels per day of heavy gas oil fractions plus 4000 barrels per day of light gas oil fractions, again to meet specification. Thus a substantially doubled treatment capacity is obtained when using a joint light and heavy fraction feedstock by merely adding the heat exchangers 22 and 26. This result is due to a multiplicity of factors, of which the most important are the following.

Diluting the heavy gas oil feed for desulphurization with a light gas oil feed results in a lower adiabatic $\Delta T$ in the desulphurization and a more efficient reaction.

Diluting the concentration in the desulphurization feedstock of the light olefins produced during dewaxing results in a reduction of the quantity thereof hydrogenated in the desulphurization stage, in which the olefin hydrogenation is an unwanted, parasite side-reaction.

Diluting the product obtained from dewaxing has the benefit of compensating the different desulphurization difficulty of the two feedstocks. The process scheme according to the invention therefore allows high production flexibility and is thus able to treat light and heavy gas oil fractions either separately or jointly, so adapting both to refinery availability and seasonal demand. The capacity for joint processing of light and heavy feedstocks also considerably lessens the storage requirements upstream and downstream of the plant.

The crude gas oil fraction able to be fed directly to the desulphurization stage can also have low-temperature characteristics slightly worse than those required, but in this case the dewaxing reaction is carried out under increased severity in order to obtain a resultant gas oil which overall satisfies the specification. Thus, a high production level can be maintained even with the limiting factor of dewaxing capacity and with crude gas oil feedstocks both of unsatisfactory low-temperature characteristics. Three examples are given hereinafter relating to the three aforesaid alternative treatments.

EXAMPLE 1

Processing of heavy gas oil from Belaym crude with the dewaxing and desulphurization stages in cascade (4000 BPSD).

(a) Feedstock characteristics

| | | |
|---|---|---|
| density | | 0.875 kg/cm$^3$ |
| volatility curve ASTM D 1160 (correlation ASTM D 2887) | | |
| % volume | °C. | |
| initial | 251 | |
| 5 | 313 | |
| 10 | 325 | |
| 20 | 341 | |
| 30 | 345 | |
| 50 | 361 | |
| 70 | 375 | |
| 80 | 383 | |
| 90 | 399 | |
| 95 | 419 | |
| total sulphur | | 1.58% by weight |
| CP | | +18° C. |
| PP | | +16° C. |

(b) Operating conditions

| | |
|---|---|
| feedstock throughput 4000 BPSD equal to | 23.2 t/h |
| process gas throughput | 24000 Nm$^3$/h |
| hydrogen content of process gas | 70% by volume |
| dewaxing reactor: | |
| inlet/outlet temperature | 402/380° C. |
| inlet/outlet pressure | 38/37 kg/cm$^3$ gauge |
| space velocity | 1 h$^{-1}$ |
| desulphurization reactor: | |
| inlet/outlet temperature | 330/375° C. |
| inlet/outlet pressure | 36.5/36 kg/cm$^3$ gauge |
| space velocity | 1 h$^{-1}$ |

(c) Product characteristics

| | | |
|---|---|---|
| density | | 0.876 kg/dm$^3$ |
| volatility curve | | |
| % volume | °C. | |
| initial | 231 | |
| 5 | 285 | |
| 10 | 303 | |
| 20 | 331 | |

-continued

| | | |
|---|---|---|
| 30 | 340 | |
| 50 | 354 | |
| 70 | 368 | |
| 80 | 377 | |
| 90 | 394 | |
| 95 | 417 | |
| total sulphur | | 0.1% by weight |
| CP | | −10° C. |
| PP | | −12° C. |

EXAMPLE 2

Processing of light gas oil from Kirkuk crude using only the desulphurization stage (8000 BPSD) in the plant of Example 1.

(a) Feedstock characteristics

| | | |
|---|---|---|
| density | | 0.838 kg/cm$^3$ |
| volatility curve ASTM D 1160 (correlation ASTM D 2887) | | |
| % volume | °C. | |
| initial | 228 | |
| 5 | 241 | |
| 10 | 248 | |
| 20 | 257 | |
| 30 | 262 | |
| 50 | 274 | |
| 70 | 289 | |
| 80 | 298 | |
| 90 | 309 | |
| 95 | 318 | |
| final | 327 | |
| total sulphur | | 1% by weight |
| CP | | −12° C. |
| PP | | −18° C |

(b) Operating conditions

| | |
|---|---|
| feedstock throughput 8000 BPSD equal to | 44.4 t/h |
| process gas throughput | 12000 Nm$^3$/h |
| hydrogen content of process gas | 70% percent by volume |
| inlet/outlet temperature | 320/330° C. |
| inlet/outlet pressure | 33/32.5 kg/cm$^2$ gauge |
| space velocity | 2 h$^{-1}$ |

(c) Product characteristics

| | |
|---|---|
| density | 0.828 kg/dm$^3$ |
| total sulphur | 0.1% by weight |
| CP | −12° C. |
| PP | −18° C. |

EXAMPLE 3

Joint processing of heavy gas oil (4000 BPSD) and light gas oil (4000 BPSD) with dewaxing and desulphurization in cascade for the heavy gas oil and only desulphurization for the light gas oil, in the plant of the preceding examples.

(a) Feedstock characteristics as in the preceding examples (b) Operating conditions

| | | |
|---|---|---|
| feedstock throughput | heavy gas oil | 23.2 t/h |
| | light gas oil | 22.2 t/h |
| process gas throughput | | 24000 Nm$^3$/h |
| hydrogen content of process gas | | 70% by volume |
| dewxaing reactor: | | as Ex. 1 |
| desulphurization reactor: | | |
| inlet/outlet temperature | | 325/360° C. |
| inlet/outlet pressure | | 36.5/36 kg/cm$^3$ gauge |
| space velocity | | 2 h$^{-1}$ |

(c) Product characteristics

| | |
|---|---|
| density | 0.860 kg/dm$^3$ |
| total sulphur | 0.1% by weight |
| CP | −11° C. |
| PP | −15° C. |

We claim:

1. A process for producing high-quality gas oil which comprises:

subjecting a heavy crude gas oil to a catalytic dewaxing step in the presence of hydrogen, subjecting the resulting dewaxed heavy crude gas oil to a desulfurization step without undergoing any separation treatment, subjecting by heat exchange a light crude gas oil to a preheating step by heat exchanging it against the effluent of the crude gas oil from the desulfurization step, combining the resulting light crude gas oil from the preheating step with the effluent from the catalytic dewaxing step, simultaneously subjecting the heavy crude gas oil resulting from the dewaxing step and the preheating step to said desulfurization step, and recovering a high-quality gas oil.

2. The process according to claim 1, wherein said light crude gas oil consists of a light gas oil with a distillation range of 170° C. to 340° C.

3. The process according to claims 1 or 2, wherein said heavy crude gas oil has a final distillation temperature of 450° C.

4. The process according to claim 1, wherein the feed temperature of the heavy crude gas oil to the catalytic dewaxing step is controlled and adjusted by monitoring and in response to desired low-temperature characteristics of the effluent from the catalytic dewaxing step.

5. The process according to claim 1, wherein said catalytic dewaxing step in the presence of hydrogen is carried out at a pressure of 24–40 atm and at a temperature of 300°–430° C.

6. The process according to claim 5, wherein the gaseous hydrogen: heavy crude gas oil has a volume ratio of 100–500.

7. The process according to claims 1, 5 or 6, wherein said desulfurization step is carried out at a pressure of 20–40 atm and at a temperature of 290°–390° C.

* * * * *